United States Patent [19]

Apicelli et al.

[11] 4,408,815

[45] Oct. 11, 1983

[54] HIGH COMPLIANCE ROLL-IN CHANNEL WIRE TERMINATION

[75] Inventors: Samuel W. Apicelli, Highspire, Pa.; Dimitry G. Grabbe, Lisbon Falls, Me.

[73] Assignee: AMP Incorporated, Harrisburg, Pa.

[21] Appl. No.: 315,833

[22] Filed: Oct. 28, 1981

[51] Int. Cl.[3] ..... H01R 11/08

[52] U.S. Cl. ..... 339/95 R; 339/276 T

[58] Field of Search ..... 339/95 R, 97 R, 97 P, 339/98, 99 R, 276 R, 276 T, 277 R

[56] References Cited

U.S. PATENT DOCUMENTS

| | | | |
|---|---|---|---|
| 1,536,338 | 5/1925 | Glamzo | 339/277 |
| 3,038,958 | 6/1962 | Swengel | 174/94 |
| 3,405,385 | 10/1968 | Rapp | 339/97 R |
| 3,777,051 | 12/1973 | Ziegler, Jr. et al. | 174/94 R |
| 4,173,388 | 11/1979 | Brandeau | 339/276 T |
| 4,225,208 | 9/1980 | Brandeau et al. | 339/95 R |

FOREIGN PATENT DOCUMENTS

| | | | |
|---|---|---|---|
| 2481527 | 10/1981 | France | 339/98 |

*Primary Examiner*—Joseph H. McGlynn
*Attorney, Agent, or Firm*—F. Brice Faller

[57] ABSTRACT

Solderless electrical connector receives solid wire by rolling wire progressively into a channel between two elongate plate-like members formed from an integral base against which the wire is rolled. At least one of the plate-like members yields resiliently to accommodate a wide range of wire sizes and further maintains contact force on the terminated wire.

10 Claims, 5 Drawing Figures

HIGH COMPLIANCE ROLL-IN CHANNEL WIRE TERMINATION

BACKGROUND OF THE INVENTION

The present invention relates to electrical connectors for solderless wire termination, particularly to a connector adapted to have the wire axially channeled in the slot.

Electrical connectors having wire-receiving slots are well known. See, e.g., U.S. Pat. No. 4,116,522. Most such connectors employ a metal plate with a slot profiled therein, or employ a plate folded along an axis perpendicular to an elongate aperture in order to form a slot. See, e.g., U.S. Pat. No. 4,261,629. The slot in this prior art is intended to receive a wire inserted laterally of the wire axis. It is also known to insert a wire into a groove by pressing a wire therein parallel of its axis as in U.S. Pat. Nos. 3,038,958 and 3,777,051, as well as to press a wire into a slotted plate parallel of its axis as in U.S. Pat. Nos. 4,173,388 and 4,225,208. The latter two patents disclose laying the wire to be terminated against a slot in a plate and forcing the wire progressively into the slot from a throat portion to a narrower wire-contacting portion of the slot. The wire has its sides sheared along the axis of the wire and is coined or mashed into the slot. The slot is substantially non-yielding and the termination is in the form of a crimp.

SUMMARY OF THE INVENTION

The present invention relates to a roll-in-slot type terminal employing two adjacent elongate plate-like members having edges forming a channel therebetween and lying against a base portion from which the elongate members are formed. In one embodiment, a metal plate is folded against itself at parallel bights to form elongate plate-like members in the form of laps with a channel therebetween. The plate is notched along one of the fold lines so that one of the laps has a much shorter bight and extends toward the other lap as a cantilever beam. The channel is open at one end and converges into a wire-receiving portion where the distance between laps decreases to less than the diameter of the smallest wire to be terminated. The cantilever beam flexes as a wire is rolled into the wire-receiving portion. In an alternative embodiment, the elongate plate-like members are stamped from the plate leaving apertures therein.

An object of the invention is to provide a single connector suitable for terminating a large range of wire sizes.

An object is to provide a high compliance termination with a large wire contact area.

Another object is to provide a roll-in type termination where the surface against which the wire is rolled is integral with the terminal.

A related object is to provide a low-profile terminal which terminates the wire parallel to its axis.

DETAILED DESCRIPTION OF THE PREFERRED EMBODIMENT

Figure 1:
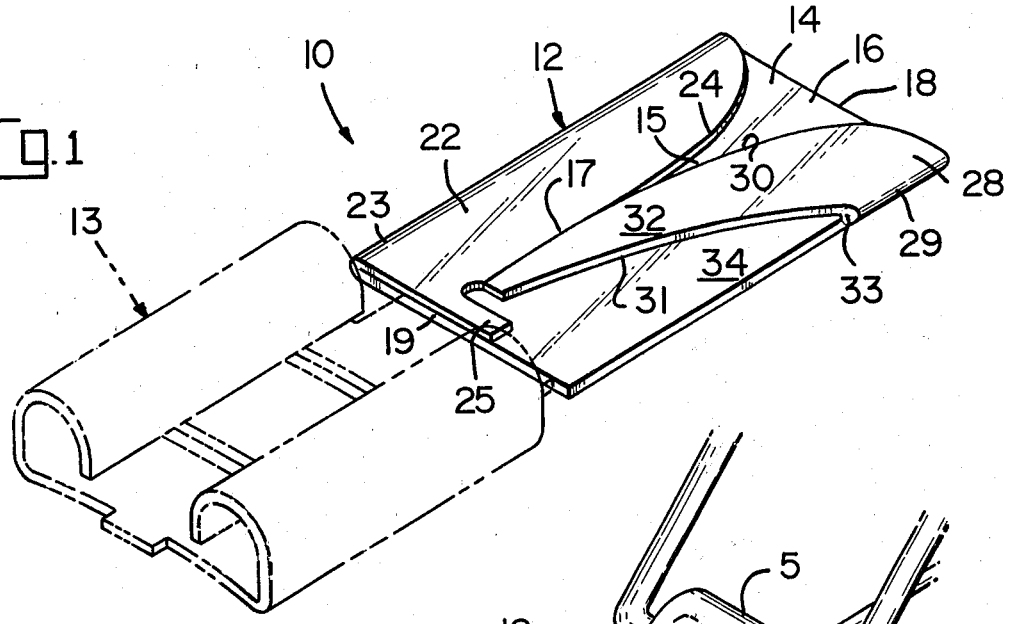
FIG. 1 is a perspective of the terminal.

FIG. 1 depicts a connector 10 with a wire-terminating portion or terminal 12 as taught by the present invention and a mating portion 13. The mating portion 13 as shown herein is in the form of a spade-receiving terminal but could also be formed as a socket or other terminal for use with the present invention. The terminal 12 has a base portion 14 which extends from a first end 18 to a second end 19. The terminal 12 is folded against itself at first bight 23 to form first lap 22 which lies against the base portion 14. The terminal 12 is folded against itself at second bight 29 parallel to first bight 23 to form second lap 28. The laps 22, 28 have respective facing first and second edges 24, 30 which define a wire-receiving channel 15 therebetween. The channel 15 has an entry portion 16 at first end 18 and converges to a wire-receiving portion 17 toward second end 19. The edges 24, 30 converge gradually until they meet, at which point the second lap 28 ends and the first lap 22 has an overlap 25 which extends beyond the channel 15.

The terminal 12 has a notch 34 along the fold line of bight 29, so that bight 29 is foreshortened as compared to bight 23 and the second lap 28 extends from the bight 29 toward first lap 22 in the form of a cantilever beam 32. The beam is profiled opposite second edge 30 by a rear edge 31 which extends from the end of the beam to the apex 33 of notch 34, which is also referred to as a point 33 intermediate ends 18, 19 of the base portion 14.

Figure 2:
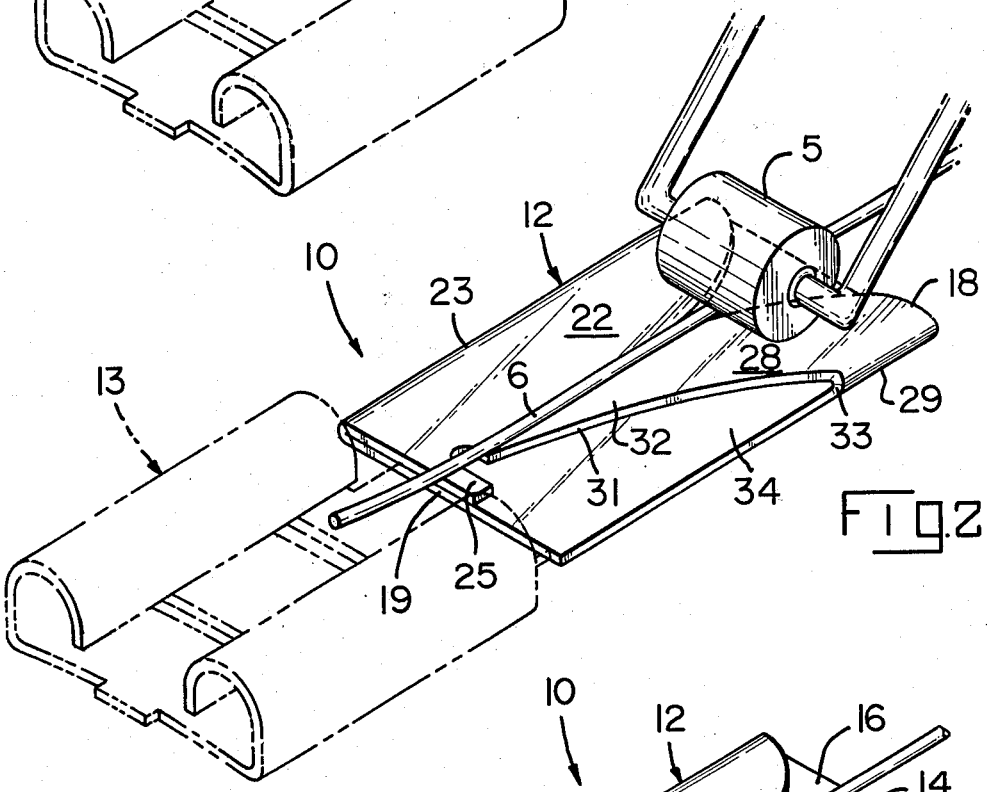
FIG. 2 is a perspective of the terminal as a wire is placed for termination.

FIG. 2 shows a wire 6 laid against channel 15 with roller 5 poised to roll the wire 6 therein. The wire lies in entry portion 16 against the base portion 14 of the terminal 12, and the roller 5 keeps the wire 6 against the base portion 14 while the roller 5 advances and the wire 6 causes the cantilever beam 32 to flex as the channel 15 conforms to the wire 6. Insofar as the beam 32 flexes to accommodate the wire, a wide range of wire sizes, e.g., 1 mil to 20 mils, can be terminated using a single size terminal. The elasticity of the cantilever beam 32 is determined by the arm length and the cross-section area, which in turn is determined by the thickness of the metal and the width between the second edge 30 and rear edge 31. Additional stiffness is designed in where it is desired to strip plastic or varnish insulation from the wire being terminated. It should be noted that, while the wire is not cut and mashed as it is in the prior art, some scraping along the axis of the wire does occur while it is being rolled into the channel 15. This assures good electrical contact, which is maintained by the spring force in the cantilever beam 32.

Figure 3:
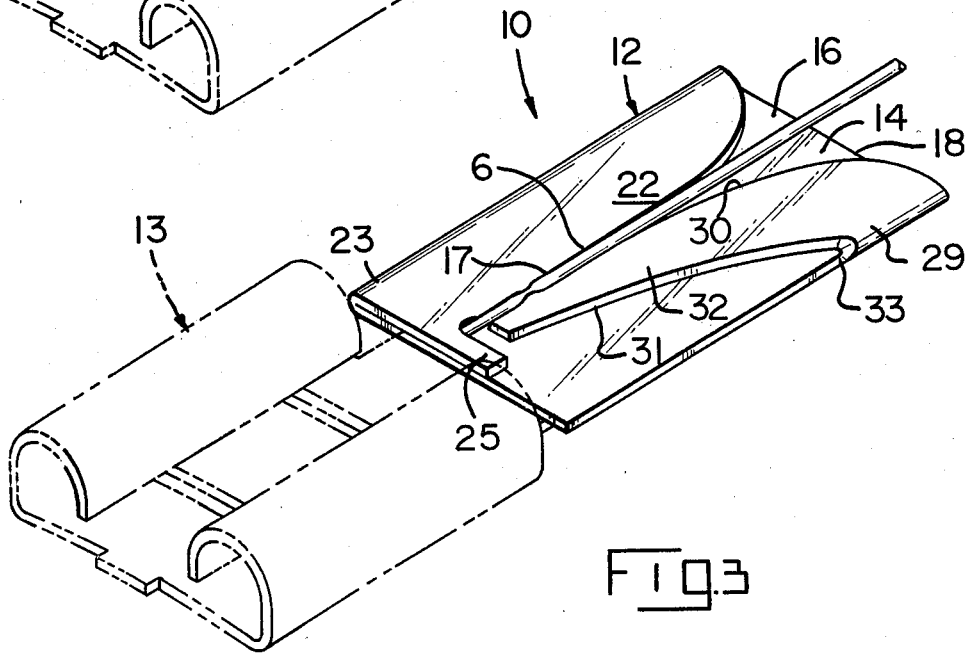
FIG. 3 is a perspective of a terminal with a terminated wire.

FIG. 3 depicts a terminated wire. The end of the wire has been trimmed as the roller 5 pressed it against overlap 25. The edges 24, 30 of the laps 22, 28 are coined slightly as is optional to help retain the wire 6 in the channel 15 against the base portion 14.

Figure 4:
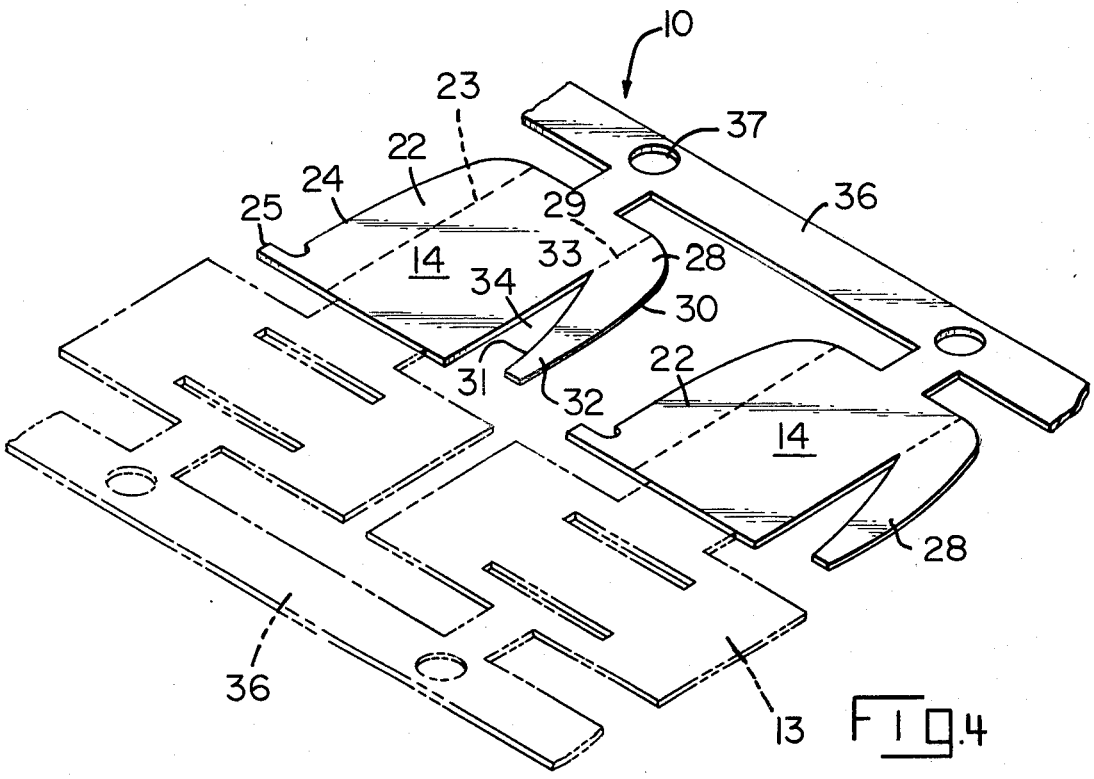
FIG. 4 is a perspective of the terminal in strip form prior to forming.

FIG. 4 shows the connector 10 in strip form after stamping and prior to forming. Carrier strips 36 and indexing holes 37 permit ready indexed movement through the forming dies, and the strips 36 may be used to package the connectors in reel form or transport them for additional operations such as application to a connector or wire insertion.

Figure 5:
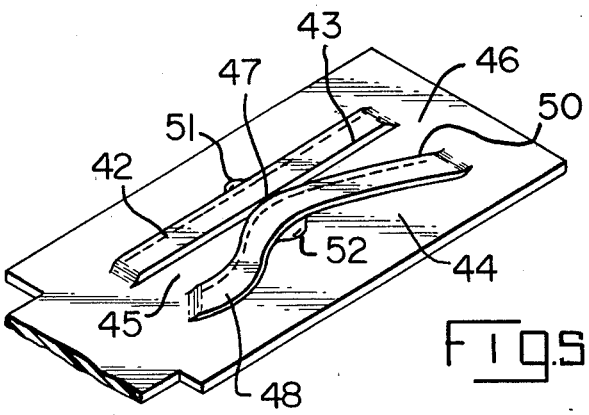
FIG. 5 is a perspective of an alternate embodiment of the terminal.

FIG. 5 depicts an alternative embodiment of the terminal of the instant invention wherein a wire-receiving channel 45 is formed between two elongate plate-like members 42, 48 which are stamped from a base portion 44. The plate-like members 42, 48 have respective facing first and second edges 43, 50 which define the wire-receiving channel 45 therebetween. The channel has a wire-entry portion 46 and converges toward a wire-receiving portion 47. Both elongate members 42, 48 are attached at both ends to the base portion 44; compliance to different wire sizes is achieved by a predetermined combination of length, width, thickness, and shape of the elongate members 42, 48. Both members 42, 48 will be resilient and thus provide the residual spring force necessary for effective wire termination. Note that the base portion 44 of the terminal is mashed or coined at 51, 52 adjacent to elongate members 42, 48 so that the elongate members 42, 48 will not collapse into the apertures below as a wire is rolled into the channel 45.

The above descriptions are exemplary and not intended to limit the scope of the claims which follow.

We claim:

1. An electrical connector of the type comprising a first end, a second end, and a wire-receiving channel extending inwardly from said first end toward said second end, said channel having opposed first and second edges which converge from said first end to a wire-contacting portion toward said second end, said opposed edges being spaced apart at said wire-contacting portion by a distance which is less than the diameter of a wire for which said device is intended, said wire being axially channeled in said slot, characterized in that said connector comprises a plate-like member having generally parallel first and second bights where said member is folded against a base portion of said member to form respective first and second laps which define respective first and second edges of said wire-receiving channel.

2. The connector of claim 1 characterized in that said first bight extends from said first end to said second end.

3. The connector of claim 1 characterized in that said first lap extends beyond the center line of said channel at said second end, said second lap being incomplete between said channel and said second end.

4. The connector of claim 1 characterized in that said second edge approaches the center line of said channel substantially asymptotically.

5. The connector of claim 1 characterized in that said second bight extends from said first end to a point intermediate said ends of said member, said second lap having a cantilever beam portion bounded by said second edge and a rear edge between said point intermediate and said second end.

6. The connector of claim 5 characterized in that said cantilever beam portion becomes increasingly narrow toward said second end.

7. An electrical connector stamped and formed from sheet metal comprising:

a base portion having opposed first and second ends;

first and second laps integral with said base portion and folded thereagainst at respective opposed first and second bights, said bights being substantially parallel and lying between said first end and said second end, said laps having adjacent respective first and second edges which converge from said first end toward said second end to form a wire-receiving channel therebetween, whereby, a wire may be pressed progressively into said channel from said first end toward said second end against said base portion.

8. The connector of claim 7 wherein said second bight extends from said first end to a point intermediate said ends, said second lap having a cantilever beam portion between said bight and said second end, said beam portion being fixed only at said bight, whereby, a wire of larger diameter than said channel may be pressed progressively into said channel and said second lap will flex to accommodate said wire.

9. An electrical connector stamped and formed from sheet metal comprising:

a substantially planar base portion having opposed first and second ends, a substantially planar terminating portion lying against said base portion, said terminating portion comprising a pair of opposed elongate plate-like members defining a channel therebetween over said base portion, said plate-like members being attached to said base portion toward said first end, said channel becoming increasingly narrower from said first end toward said second end, whereby, a wire may be pressed progressively into said channel from said first end toward said second end against said base portion.

10. The connector of claim 9 wherein each said plate-like member lies immediately above an aperture in said base portion, said aperture being profiled as the respective plate-like member, each said plate-like member having been formed by die-stamping through said base portion, said apertures in said base portion having been coined subsequent to stamping said plate-like members, whereby, said apertures will not receive said plate-like members if pressure is brought to bear on said plate-like members while said wire is being rolled into said channel.

* * * * *